US005888952A

United States Patent [19]

Subramanyam et al.

[11] Patent Number: 5,888,952

[45] Date of Patent: Mar. 30, 1999

[54] SOLID CLEANSING COMPOSITION COMPRISING TETRASODIUM PYROPHOSPHATE

[75] Inventors: Ravi Subramanyam; Syed Abbas, both of Belle Mead, N.J.

[73] Assignee: Colgate-Palmolive Co., New York, N.Y.

[21] Appl. No.: 874,391

[22] Filed: Jun. 13, 1997

[51] Int. Cl.[6] ..... C11D 9/08

[52] U.S. Cl. ..... 510/150; 510/152; 510/153; 510/481; 510/486

[58] Field of Search ..... 510/130, 141, 510/150, 152, 153, 481, 486

[56] References Cited

U.S. PATENT DOCUMENTS

| | | | |
|---|---|---|---|
| 2,402,473 | 6/1946 | Zile | 252/109 |
| 2,686,761 | 6/1954 | Ferguson et al. | 510/147 |
| 3,494,869 | 2/1970 | Armstrong | 252/109 |
| 4,007,124 | 2/1977 | Collier et al. | 510/352 |
| 4,297,230 | 10/1981 | Rasser | 252/117 |
| 4,678,593 | 7/1987 | Ridley | 510/147 |
| 4,719,030 | 1/1988 | Williams et al. | 510/147 |
| 4,874,538 | 10/1989 | Dawson et al. | 510/147 |
| 4,985,170 | 1/1991 | Dawson et al. | 510/147 |
| 5,571,287 | 11/1996 | Subramanyam et al. | 510/150 |

FOREIGN PATENT DOCUMENTS

| | | |
|---|---|---|
| 0607004 | 7/1994 | European Pat. Off. . |
| 2231882 | 11/1990 | United Kingdom . |
| 9502035 | 1/1995 | WIPO . |
| 9635772 | 11/1996 | WIPO . |

*Primary Examiner*—Necholus Ogden
*Attorney, Agent, or Firm*—Martin B. Barancik

[57] ABSTRACT

A solid cleansing composition comprising a) soap, b) moisture, c) from about 0.5 to about 5 wt. % TSPP, and d) free fatty acid in a quantity such that a pH above about 9.5 is present when he pH of a 1 wt. % soap bar in water solution is measured.

5 Claims, No Drawings

SOLID CLEANSING COMPOSITION COMPRISING TETRASODIUM PYROPHOSPHATE

BACKGROUND OF THE INVENTION

Tetrasodium pyrophosphate (TSPP) is known for establishing structural properties in soap bars. It is also generally known that the presence of free-fatty acids can significantly reduce the structurant properties of soap bars, i.e. make them softer and more amenable to high wear rate. However, the presence of free-fatty acids increases the lather and skin feel. Therefore, its presence is considered to be an overall positive in soap bars.

It has now been found that certain quantities of free-fatty acid can be incorporated into a soap bar having structurant affecting quantities of TSPP while essentially retaining the structuring affect of the TSPP.

SUMMARY OF THE INVENTION

In accordance with the invention, there is a cleansing bar composition comprising a) soap, b) moisture, c) from about 0.5 to about 5 wt. % TSPP, and d) free fatty acid in a quantity such that a pH above about 9.5 is present when the pH of a 1 wt. % soap bar in water composition is measured.

DETAILED DESCRIPTION OF THE INVENTION

Soap is a long-chain alkyl carboxylate salt. Generally the alkyl group is from about 10 to about 20 carbon atoms in length, preferably about 12 to 18 carbon atoms in length. The alkyl is preferably normal, although up to about 25% of the alkyl chains can have branching. Preferably no more than about 10 to 20% of the alkyl chains may have unsaturation therein. The cation can be an alkali or an ammonium or substituted ammonium material. Generally, the sodium salt is preferred.

The free-fatty acid incorporated into the soap bar is generally from about 10 to about 20 carbon atoms in length, inclusive, preferably about 12 to 18 carbon atoms, inclusive. The free-fatty acids are preferably normal as opposed to branched. Generally no more than about 20 to 25% of the alkyl groups are branched. The acids are preferably saturated but some unsaturation can occur. Examples of such free-fatty acids include lauric, myristic, palmitic, and stearic.

The TSPP is an essential aspect of the invention. Only the sodium salt of the pyrophosphate can be employed. The potassium salt is ineffective in providing the desired structurant properties. The quantity of the TSPP is sufficient to obtain desired structural properties, in particularly the reduction of slough. Various other structurant properties can be measured and are preferably improved as well, for example the percent wear. Generally from about 0.5 to about 5 wt. % of the bar composition is TSPP, preferably about 1.5 to about 4 wt. % of the bar composition.

The quantity of free-fatty acid which can be employed in the composition is from about 1 wt. % to a maximum amount which will bring about a pH no lower than about 9.5 measured on a 1 wt. % bar composition in water, preferably no lower than a pH of about 10.0. Below this pH, the presence of the acid appears to be detrimental to the composition. The particular pH which one should not go below can vary depending upon the precise solid composition. Generally the free-fatty acid is no more than about 10 wt. % of the composition. However, quantities of about 9, 8 and 7 wt. % are also effective maxima. The minimum wt. % of free-fatty acid is preferably about 2 or about 3 wt. % of the composition for useful positive effects.

The soap is the major component of the bar. Generally, at least about 70 wt. % of the bar is soap, preferably at least about 80 or even 85 wt. % of the bar is soap. The soap can be made up of alkyl carboxylate salts of varying carbon chain lengths. Generally, the lower carbon materials that is the lauric or the myristic, i.e. derived from coconut oil, will provide greater lather but lower structurant properties. The higher alkyl chain length such as palmitic and stearic, derived from such natural products as tallow for example, will provide less lather but greater structurant properties. Generally, for a mix of properties favoring greater structurant attributes, a soap mix having no more than about 25 to 30% of the alkyl chains having less than or equal to 14 carbon atoms is preferred.

Moisture comprises the major portion of the remainder of the bar. This is generally a minimum of about 5 wt. % of the composition and up to about 15 wt. %.

Below are examples of the invention. These examples are intended to be exemplary of the invention and not unduly limit the general inventive concept.

EXAMPLES

Example 1

A soap bar having soap 40% derived from tallow and 60% derived from coconut oil, the bar additionally having 5 wt. % coco fatty acid is made by vacuum drying of the neat soap to about 13–14 wt. % moisture. Fatty acid is neutralized in a crutcher to make the soap. The system is mixed with 0.2 wt. % titanium dioxide, milled three times and plodded into bars. These bars are evaluated for certain product attributes after 15 days of aging. These are the control bars. The invention bars are prepared by replacing three wt. % of the soap (based on bar composition) and adding 3 wt. % TSPP, based on bar composition.

The test procedure used for the control and the invention are the following.

Slough Test (high humidity)—The weight of the bar was recorded in grams. The bars were washed twice at 30 minute intervals for 10 seconds at 100° F. before testing. The bar was placed in a soap dish (120 mm×75 mm×16 mm). The dish was filled with tap water, and the bar remained in the water for 17 hours at 35°–40° C. at 100% relative humidity. At the end of 17 hours, the resulting soft material (slough) was removed using finger pressure. The bar weight was recorded. The weight loss was determined as the loss per 100 grams.

Wear By Repeated Hand Wash—In this method, the soap bars were repeatedly washed and then allowed to dry. The test was carried out over a 4-day period in order to simulate at-home usage. The initial weights of the bars were recorded. A few different individuals washed the bars for 10-second intervals in warm tap water (90°–100° F.). The soap bars were placed in a soap dish with a grid to allow drainage of water. The bars were allowed to dry for at least a 30-minute interval between washings. The soap bars underwent a total of 20 washes of 10-second duration, and were then dried for 24 hours prior to reweighing. The results were reported both as weight loss per 100 grams, as well as per use. Below are the results:

| | Control | Example 1 (TSPP) |
|---|---|---|
| % Slough | 12.3 | 10.8 |
| % Wear | 21.5 | 21.5 |

Example 2

The sample procedures of example 1 are followed except for the following: the soap is derived from 85 wt. % tallow and 15 wt. % coconut oil. The bar composition is 6 wt. % coco fatty acid. 4 wt. % TSPP is used in example 2. The soap is tray dried to about 12 wt. % moisture. Extra coco fatty acid is added in the crutcher to maintain 6 wt. % free-fatty acid in the final bar.

| | Control | Example 2 (TSPP) |
|---|---|---|
| % Slough | 21.0 | 17.5 |
| % Wear | 22.1 | 18.7 |

Example 3

The bound (hydrated form) and free moisture in the soap samples of the control of examples 1 and 2 and examples 1 and 2 per se are measured by differential scanning calorimetry (DSC). It is thought that the more bound soap that is present, the better the structurant properties.

| Sample | Free | Water Bound | Total |
|---|---|---|---|
| Example 1 Control | 4.3 | 7.2 | 11.5 |
| Example 1 | 2.74 | 9.55 | 12.29 |

-continued

| Sample | Free | Water Bound | Total |
|---|---|---|---|
| Example 2 Control | 6.17 | 5.51 | 11.68 |
| Example 2 | 3.18 | 10.06 | 13.24 |

TSPP plus free fatty acid containing bars have substantially more bound water than the control bars containing only the free-fatty acid.

The bars of the inventions are employed to cleanse the human skin. They lather well with water and are readily rinsed.

What is claimed is:

1. A solid cleansing composition comprising a) at least about 70 wt. % of soap, b) 5–15 wt. % of moisture, c) from about 0.5 to about 5 wt. % tetrasodium pyrophosphate, and d) free fatty acid in a quantity such that a pH above about 9.5 is present when the pH of a 1 wt. % soap bar in water composition is measured said acid being 3–10 wt. % wherein tetra sodium pyrophosphate provides reduction of slough and wear resistant characteristics.

2. The composition in accordance with claim 1 wherein the pH is above about 10.0.

3. The composition in accordance with claim 1 wherein tetrasodium pyrophosphate is about 1.5 to about 4 wt. % of the composition.

4. The composition in accordance with claim 1 wherein the free-fatty acid has from about 8 to about 18 carbon atoms, inclusive.

5. The composition in accordance with claim 1 wherein the soap contains less than about 25 wt. % alkyl carboxylate salts having 14 carbon atoms or less in the alkyl group.

* * * * *